US005356369A

United States Patent [19]

Yamasaki et al.

[11] Patent Number: 5,356,369

[45] Date of Patent: Oct. 18, 1994

[54] PORTABLE VIBRATION FINGER PRESSURE MASSAGER

[75] Inventors: Yoshikiyo Yamasaki, Sakai; Shinichiro Fujimoto, Osaka, both of Japan

[73] Assignees: Kabushiki Kaisha Japan Health; Kabushiki Kaisha Fuji Iryoki, both of Osaka, Japan

[21] Appl. No.: 897,278

[22] Filed: Jun. 11, 1992

[51] Int. Cl.[5] ..... A61H 1/00; A61H 7/00

[52] U.S. Cl. ..... 601/70; 601/113; 601/134

[58] Field of Search ..... 128/32–36, 128/45, 46, 44, 54, 46; 601/113, 134

[56] References Cited

U.S. PATENT DOCUMENTS

| | | | |
|---|---|---|---|
| 854,983 | 5/1907 | Clark | 128/36 |
| 2,425,655 | 8/1947 | Tompkins | 128/36 |
| 2,574,945 | 11/1951 | Werner | 128/36 |
| 3,636,945 | 1/1972 | Sato | 128/36 |
| 3,710,785 | 1/1973 | Hilga | 128/36 |
| 4,669,452 | 6/1987 | Osawa | 128/36 |
| 4,777,940 | 10/1988 | Yamasaki | 128/46 |
| 4,785,798 | 11/1988 | Yamasaki | 128/46 |
| 4,887,594 | 12/1989 | Siegel | 128/36 |
| 5,063,911 | 11/1991 | Teranishi | 128/46 X |
| 5,099,826 | 3/1992 | Hayakawa | 128/36 |
| 5,183,034 | 2/1993 | Yamasaki et al. | 128/46 X |

*Primary Examiner*—Robert A. Hafer
*Assistant Examiner*—Brian E. Hanlon
*Attorney, Agent, or Firm*—Flynn, Thiel, Boutell & Tanis

[57] ABSTRACT

A portable vibration finger pressure massager provides finger pressure massage to a body part of the user through the turning motion of massaging balls when the motor rotates in a first direction and simultaneously provides vibration and finger pressure massage when the motor rotates in an opposite direction. A weight change structure is attached to the rear shaft of the motor and becomes unbalanced when the motor rotates in the opposite direction, thereby causing the motor to vibrate. The vibration of the motor is transferred to projections provided on the massager thereby enabling the provision of vibration massage.

4 Claims, 5 Drawing Sheets

PORTABLE VIBRATION FINGER PRESSURE MASSAGER

BACKGROUND OF THE INVENTION

1. Field of the Invention

This invention relates to a portable massager which is equipped with a pair of massaging balls which make two kinds of motion by the optional rotation of a motor in one direction or in the opposite direction. More specifically, this invention relates to a portable vibration finger pressure massager which gives finger pressure massage to a body part of the user by the turning motion of a pair of massaging balls when the motor rotates in one direction, and gives vibration finger pressure massage to a body part of the user by the simultaneous turning motion and vibration of a pair of massaging balls when the motor rotates in the opposite direction.

2. Description of Prior Art

Generally, conventional portable massagers are made up of the following components. A box is equipped with a worm, and a pair of worm gears engage with both sides of the worm. A pair of massaging balls are fastened to the ends of shafts of the worm gears in series at a given angle and the worm is rotated by a motor to turn a pair of massaging balls respectively. The turning motion of the massaging balls is transmitted to a body part of user to give a finger pressure massage effect to the body part.

However, conventional portable massagers have bad problems of noise and vibration of the uneven engagement ratio between the worm and the worm gears or uneven size of the box which is equipped with the worm and the worm gears.

Accordingly, the applicant of this application has developed vibration isolation boards to solve these problems, as shown in FIG. 2, and has invented a portable finger pressure massager which is equipped with vibration isolation boards set on at least an upper surface or a lower surface of the worm gears.

Japanese Utility Model Registration No. 1662661 discloses a portable finger pressure massager 1 equipped with a pair of worm gears 3 which engage with opposite sides of the worm 2 in the box 4, as shown in FIG. 1. The massaging balls 6 are fastened to the ends of shafts 5 of the worm gears 3 in series and at a given angle to the shafts 5, and the massaging balls 6 respectively turn. The vibration isolation boards 7 are equipped with one or more ring elastic walls 8 which engage with walls of the box 4 at a given pressure and are provided on at least one side of an upper or lower surface of each worm gear 3. With noise and vibration being prevented during the rotation of the worm gears 3, the turning motion of the massaging balls 6 is transmitted to the body part of the user to give comfortable finger pressure massage effect to that body part.

Consequently, when the user uses a portable finger pressure massager 1 equipped with the vibration isolation boards 7, comfortable finger pressure massage can be provided to a body part of the user without the uncomfortable feeling from chatter or noise of the box 4, and without problems of damage to the apparatus.

Recently, however, a portable massager which has multiple functions and can give finger pressure massage, like conventional massagers, and other types of massage has been requested.

The applicant of this application has invented a portable vibration finger pressure massager satisfying this request, which is shown in FIG. 3, and has applied for Japanese Utility Model Application Heisei 3-66602.

This massager is provided with a pair of worm gears 3 which engage with opposite sides of the worm 2 in the box 4. A rotating disk 9 is provided with a conductive member on its circumference and fastened above the shaft 5 of each worm gear 3. Massaging balls 6 are fastened at a given angle to the shafts with the rotating disks.

A small motor M is installed in each massaging ball 6 and is wired to the conductive member of each rotating disk 9.

A sash weight is eccentrically and rotatably fastened to the shaft end of each small motor. Electrical connection panels are fastened to the upper surface of both sides of the box 4.

The end of panel contacts with an external power source and the panels also are in contact with the conductive member.

Rotational movement of the massaging balls and micro vibration can be applied individually and simultaneously.

Accordingly, the user can choose finger pressure massage, as with a conventional massager, and vibration finger pressure massage.

The above-mentioned portable vibration finger pressure massager of the applicant fulfills the need for a multi-function portable massager because finger pressure massage and vibration finger pressure massage can be given optionally.

However, this massager requires that the small motor, which is equipped with the sash weight, be fastened in each massaging balls. Accordingly, there has been the problem that manufacture of this massager is complicated, which increases manufacturing expenses and raises the price of the goods.

3. Object of the Present Invention

An object of this invention is to provide a portable vibration finger pressure massager having a turning structure which turns a pair of massaging balls which are linked with an outer motor. The user selects whether the rotation of the motor is in one direction or in the opposite direction and, as a result, the turning structure in the massager turns in one direction or in the opposite direction. When the motor rotates in the opposite direction, the motor vibrates and enables a vibration massage to be given to the user.

Three kinds of motion are optionally chosen and applied. The three kinds of motion are finger pressure massage through the turning motion of a pair of massaging balls fastened to the turning structure, vibration finger pressure massage which applies vibration and turning motion at the same time and vibration massage at the part of the massage box where the massaging balls are not equipped. This massager is small-sized, lightweight and easy to carry.

Another object is to provide a portable vibration finger pressure massager constructed to prevent chatter and vibration of the box of the turning structure.

This portable vibration finger pressure massager is provided with a vibration generating member which is equipped with a weight change structure at the rear shaft of the motor to accomplish the above-mentioned objects. The motor's front shaft is fastened to the worm and installed in the center of the flat box.

The massager contains the turning structure which is equipped with the worm gears which rotate and engage with opposite sides of the worm and a pair of massaging balls fastened to shafts, which are at an inclined angle to the shaft centers of the worm gears in the turning structure.

When the user changes the direction of rotation of driving the motor in one direction or in the opposite direction optionally, turning motion and vibration by a pair of massaging balls can be given properly.

This massager is characterized by the above-mentioned features.

In this invention, the ring vibration isolation boards, which are equipped with elastic walls which engage with inner walls of the flat box at a given pressure, are set on at least one side of upper surface or lower surface of each worm gear in the turning structure.

A lubricating oil is filled in between the circumference of the vibration isolation boards and the flat box.

With the prevention of noise and vibration between the worm gears and the flat box during the rotation of the worm gears, turning motion by a pair of massaging balls, turning motion and vibration can be given optionally.

This massager is characterized by the above-mentioned features.

Further, in this invention, the portable vibration finger pressure massager is equipped with round openings for the massaging balls to project through.

The massager is installed in a massage box which is equipped with an upper case equipped with a plurality of projections to transmit the vibration at corresponding positions of the openings.

The massage box is covered with flexible cover and the vibration by the projections of the massage box can be given optionally.

This massager is characterized by the above-mentioned features.

SUMMARY OF THE INVENTION

Functions of this Invention

Accordingly, the portable vibration finger pressure massager of this invention constructed as above works as follows:

The portable vibration finger pressure massager of this invention is equipped with a vibration generation means equipped with a weight change structure at the rear shaft of a motor in the drive equipment.

When the direction of rotation of driving of the motor is changed, vibration is generated.

Consequently, when the motor rotates in a first direction, normal turning motion by the massaging balls can be given and, when the motor rotates in the opposite direction, turning motion by the massaging balls and vibration can be given.

In this invention, ring vibration isolation boards are equipped with elastic walls which engage with walls of the box at a given pressure and are provided on at least one side of an upper or lower surface of each worm gear.

Lubricating oil is filled in between the circumference of the vibration isolation boards and the box. Therefore, the vibration isolation boards absorb noise and vibration from the worm gears and finger pressure massage can be given to the body part.

When the motor rotates in the opposite direction, turning motion by the massaging balls and vibration massage can be given.

Consequently, the vibration isolation boards completely absorb the noise and vibration from the gears and from the gears and the flat box arising from the differences in size of the flat box and the difference in engaging ratios between the worm and the worm gears. The lubricating oil prevents the noise arising when the elastic walls are pressed against the flat box. Therefore, an uncomfortable feeling to the user is prevented.

When the vibration is transmitted to the massaging balls by the vibration generating member, bad influences inside the turning structure are prevented, such as to the worm and the worm gears and so on and the problem of damage to the apparatus from it is avoided.

Further, in this invention, the portable vibration finger pressure massager is installed in a massage box equipped with round openings for the massaging balls to project through and vibration is transmitted to many projections on the upper case of the box. Therefore, when the rotation of the motor is changed to the opposite direction, it can give vibration massage to the body part of the user by the projections, and vibration massage and vibration finger pressure massage by the massaging balls can be given at the same time.

As a result, this invention removes the conventional various defects and meets various needs, and at least three kinds of massage, that is, finger pressure massage, vibration finger pressure massage and vibration massage can be given optionally to a body part of the user without an uncomfortable feeling.

If needed, vibration finger pressure massage and vibration massage can be given to adjoining parts at the same time.

Consequently, this invention can extend the range of use dramatically, is easy to carry, easy to use, and can be manufactured inexpensively. Therefore, it is very useful.

DESCRIPTION OF THE PREFERRED EMBODIMENT

Figure 1:
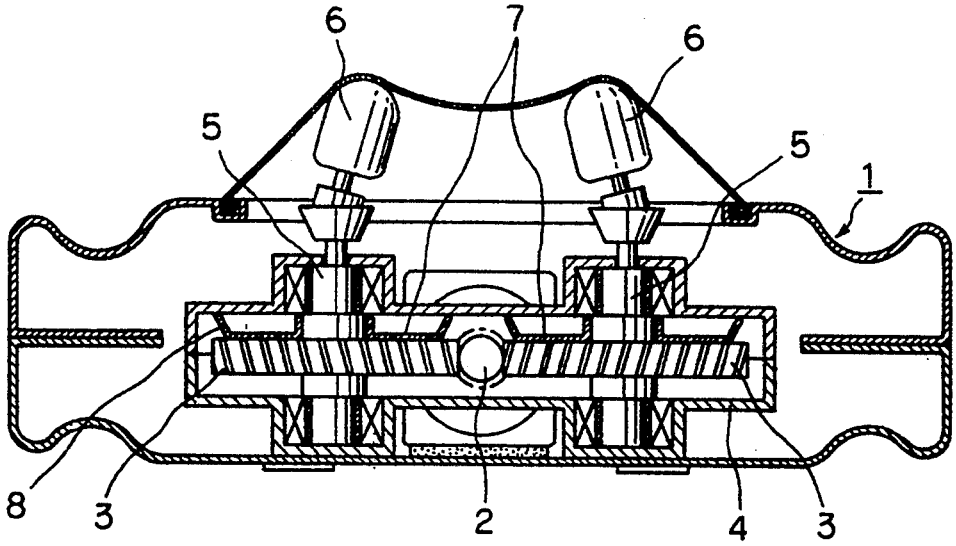
FIG. 1 PRIOR ART
FIG. 1 is a central longitudinal sectional view of an embodiment of a conventional portable massager.
Figure 2:
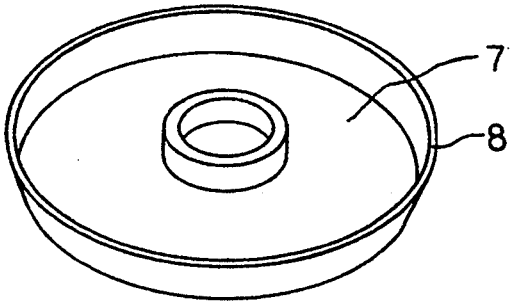
FIG. 2 PRIOR ART
FIG. 2 is a perspective view of an embodiment of a conventional vibration isolation board.
Figure 3:
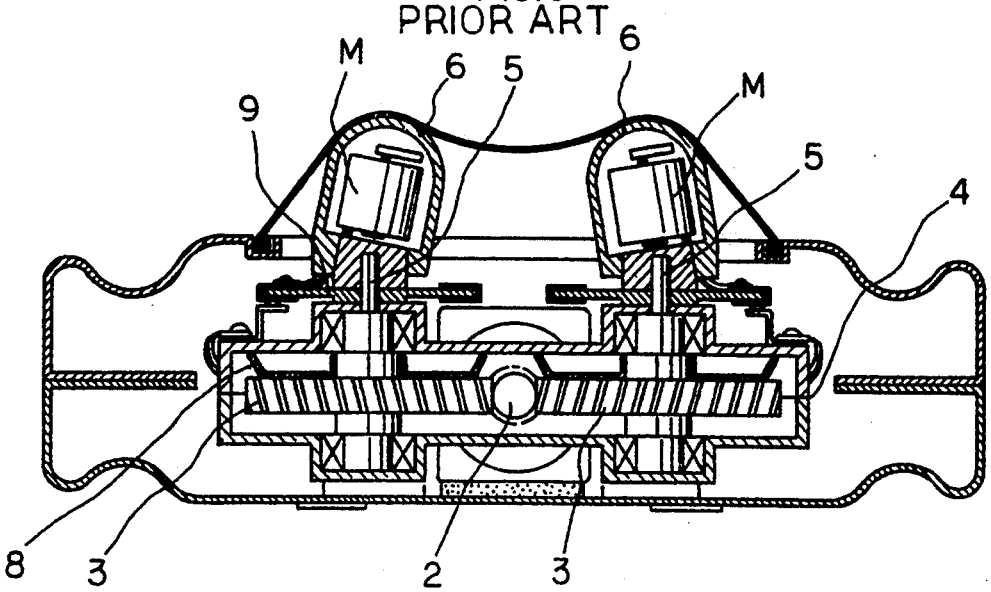
FIG. 3 PRIOR ART
FIG. 3 is a central longitudinal sectional view of an embodiment of a conventional portable vibration finger pressure massager.
Figure 4:
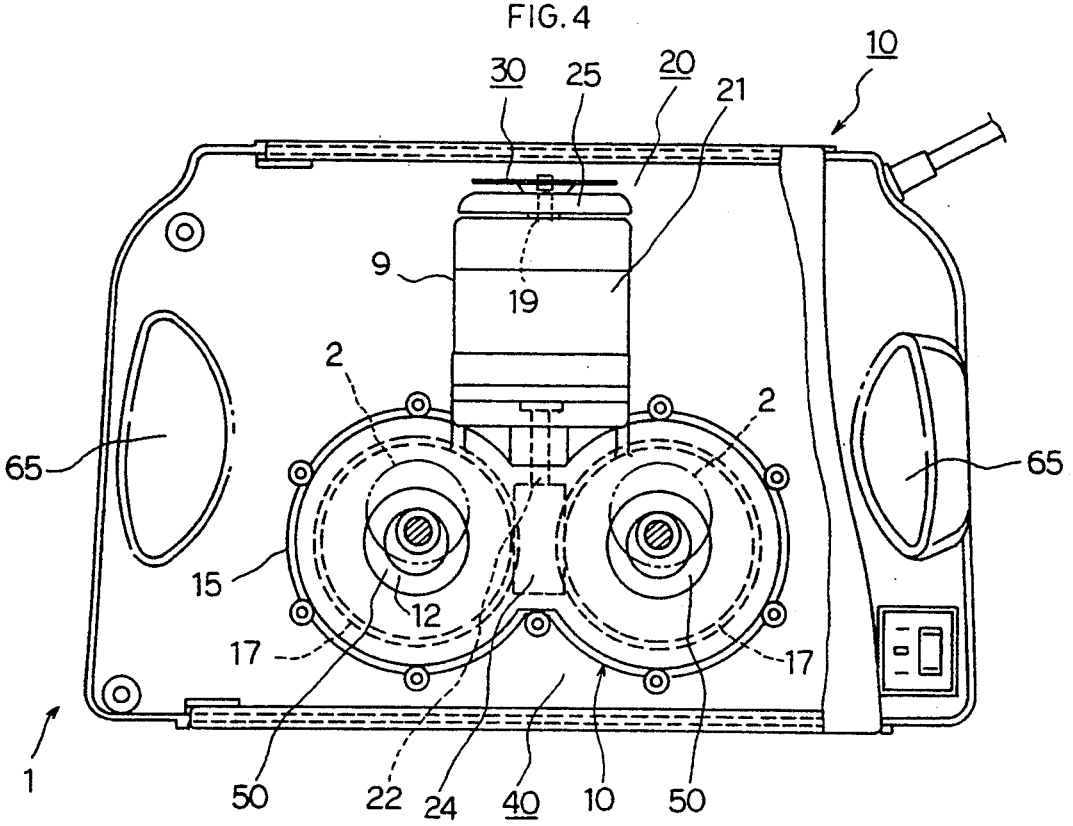
FIG. 4 is an explanatory view of an embodiment of the present invention.

Numeral 10 in FIG. 4 denotes an embodiment of the portable vibration finger pressure massager of this invention. In the portable vibration finger pressure massager 10, a turning structure 40 is driven by drive means 20 comprising a motor 21 equipped with a vibration generation means 30. A pair of massaging balls 50 are fastened above the turning structure 40 at a desired angle and undergo a turning motion and, optionally, a turning motion and vibration.

Figure 5:
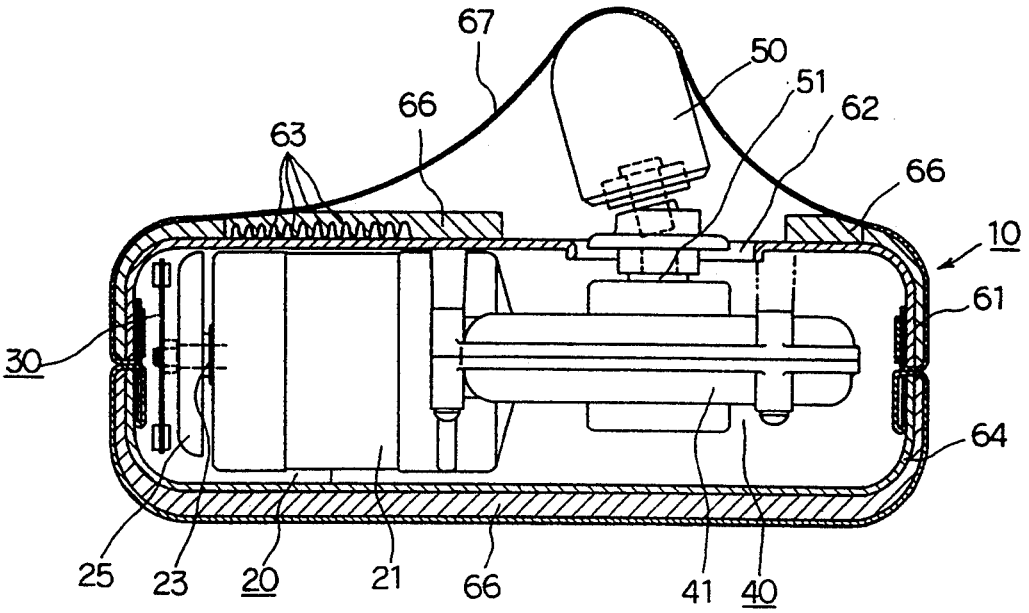
FIG. 5 is a sectional side elevation view of an embodiment of the present invention.

As shown in FIG. 5, in the drive means 20, a motor cooling fan 25 equipped with air blasting blades is fastened to the rear shaft 23 of the motor 21, which is driven in one direction or in the opposite direction by electric power supplied from an external power source. The vibration generation means 30 is provided with a weight change structure 33 fastened to the rear part of the fan 25. The front shaft 22 of the motor 21 is fastened to the worm 24.

When the power switch is at a first position or a second position, the rear shaft 23 and the front shaft 22 of the motor 21 rotate in one direction or in the opposite direction, and the fan, the vibration generation means 30 and the worm 24 rotate in one direction or in the opposite direction.

Figure 7:
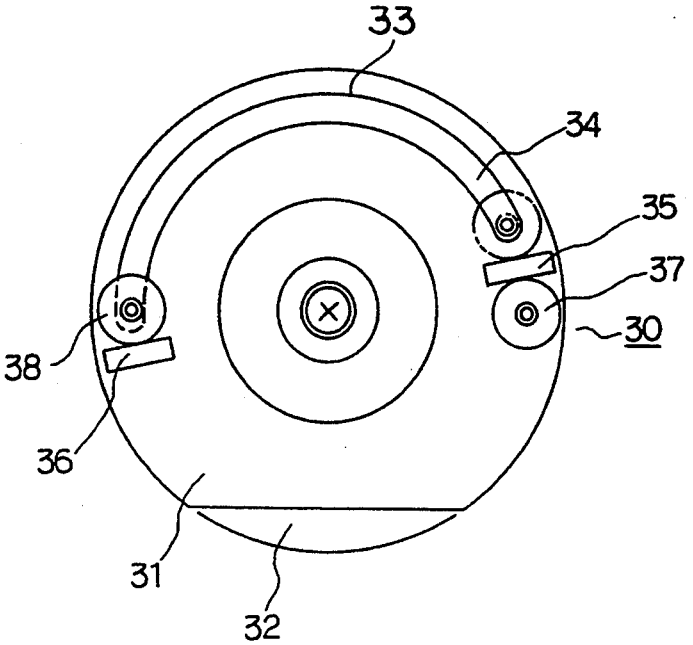
FIG. 7 is an explanatory view of an embodiment of the vibration generating member of the present invention.
Figure 8:
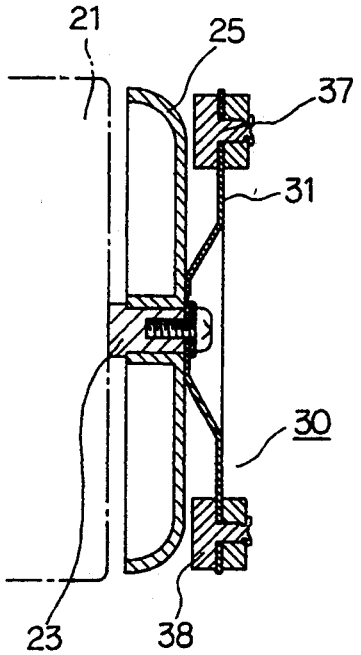
FIG. 8 is a central longitudinal sectional view of an embodiment of the present invention.

As shown in FIG. 7 and FIG. 8, the vibration generation means 30 is made up of, for example, a plate member 31 which has part 32 on one side and the weight change structure 33 attached to the plate member 31.

When the motor 21 rotates either in one direction or in the opposite direction, the weight change structure 33 engages and the motor 21, which is attached to the vibration generation means 30, vibrates.

In the weight change structure 33 of this embodiment, the arc shaped groove 34, which is less than about 180 degrees near the opposite side of part 32, is made concentrically with the plate member 31. Elastic stoppers 35, 36 are provided at both ends of the arc shape groove 34.

A first dead weight 37 has a given weight and is attached at the side of the part 32 of the plate member 31 near the elastic stopper 35. A movable second dead weight 38, which has the same weight as the first dead weight 37, is slidably affixed in the arc shaped groove 34. When the outer motor 21 rotates in one direction, the movable second dead weight 38 moves to the side of another elastic stopper 36 by the centrifugal force of the plate member 31.

The movable second dead weight 38 and the first dead weight 37 are stabilized at positions of point symmetry to the center of plate member 31, the weight of the plate member 31 at the side of the first dead weight 37 and that of the side of the movable second dead weight 38 are balanced and allow continuous normal rotation.

Conversely, when the outer motor 21 rotates in the opposite direction, the movable second dead weight 38 moves to the side of the elastic stopper 35 by the centrifugal force of the plate member 31. The movable second dead weight 38 and the first dead weight 37 are stabilized between gears and the flat box from differences in size of the flat box and differences in the engaging ratios between the worm and the worm gears completely. Consequently, the uncomfortable feeling to the user is prevented. Problems inside the turning structure, such as with the worm and the worm gears, when the vibration is given to massaging balls by the vibration generating member, are also prevented.

Further, in this invention, the portable vibration finger pressure massager is installed in a massage box equipped with openings for the massaging balls to project therethrough. Vibration is also transmitted through projections provided on the upper case of the box. Consequently, when the direction of rotation of the motor shafts is changed, the massaging balls and the projections on the massage box vibrate.

The portable vibration finger pressure massager of this invention is provided with a vibration generation means which is equipped with the weight change structure at the rear shaft of the motor in the drive equipment. Only when the rotation of driving of the motor is changed to the opposite direction is the vibration generated. Accordingly, there is no need for a small motor to be installed in the massaging ball as in conventional portable massagers.

By changing the direction of rotation of the motor shafts, the massager gives at least two kinds of motion. While the body part of the user is pressed against the massaging balls, the motor rotates in one direction and the massaging balls make a turning motion. On the opposite side of the plate member 31, the elastic stopper 35 acts as a border for the movement of the movable second dead weight. At the time, the weight of the plate member 31 is unbalanced towards one side, therefore, the motor 21 generates a vibration from imbalance of the weight of the plate member 31.

Figure 9:
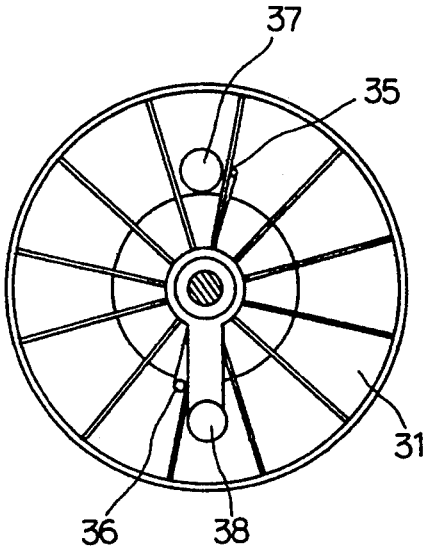
FIG. 9 is an explanatory view of a second embodiment of the vibration generating member of the present invention.
Figure 10:
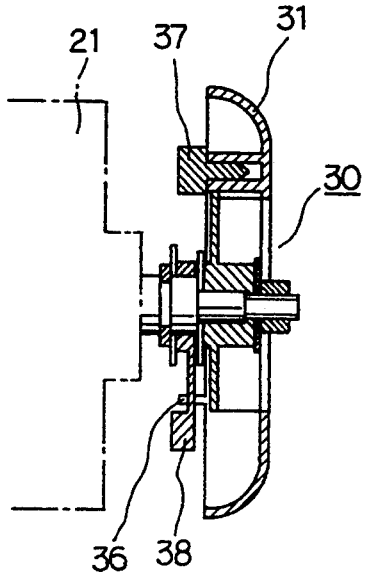
FIG. 10 is an explanatory view of the second embodiment of the vibration generating member of the present invention.

FIG. 9 and FIG. 10 illustrate second embodiments of the vibration generation means 30. In these figures, the vibration generation means 30 is the circular plate 31, which is equipped with the weight change structure 33.

When the motor 21 rotates in one direction or in the opposite direction, the weight change structure 33 engages so that the motor 21, which is equipped with the vibration generation means 30, vibrates when the motor 21 rotates in the opposite direction.

The weight change structure 33, in this case, is made up of a plate 31, which is equipped with a first dead weight 37 having a given weight and an elastic stopper 35. The elastic stopper 36 is fastened at the position of point symmetry of the elastic stopper 35 of the plate 31.

A movable second dead weight 38, which has the same weight as the first dead weight 37, can abut with the elastic stopper 36 and is rotatably attached to the shaft center of the plate 31. When the motor 21 rotates in one direction, the movable second dead weight 38 moves to the side of the elastic stopper 36 by the centrifugal force of the plate 31. The movable second dead weight 38 and the first dead weight 37 are stabilized at the positions of point symmetry to the center of the plate 31. As such, the weight of the plate 31 at the side of the first dead weight 37 and at the side of the movable second dead weight 38 are balanced to allow continuous normal rotation.

Conversely, when the motor 21 rotates in the opposite direction, the movable second dead weight 38 moves to the side of the elastic stopper 35 by the centrifugal force of the plate 31. The movable second dead weight 38 and the first dead weight 37 are stabilized oppositely at one side of the board 31 with the elastic stopper 35 as the border.

At this time, the weight of the plate 31 is unbalanced towards one side. Therefore, the motor 21 generates a vibration from the imbalance of the plate 31.

Figure 11:
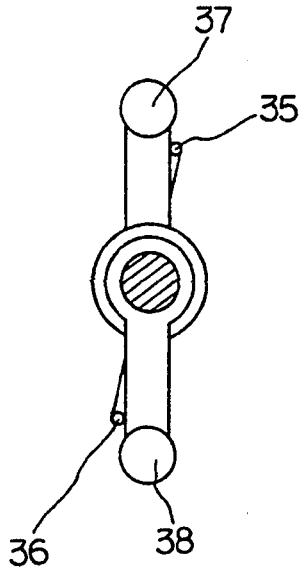
FIG. 11 is an explanatory view of a third embodiment of a vibration generating member of the present invention.
Figure 12:
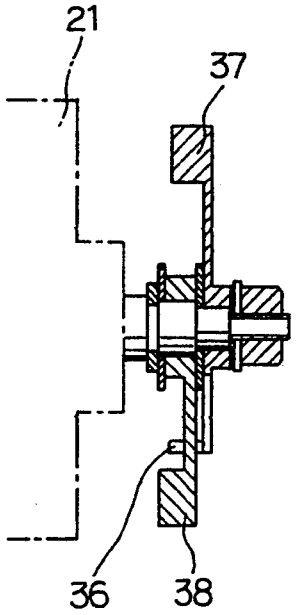
FIG. 12 is an explanatory view of the third embodiment of the vibration generating member of the present invention.

FIG. 11 and FIG. 12 illustrate a third embodiment of the vibration generation means 30.

This vibration generation means 30 comprises a weight change structure 33 fastened to the rear shaft 23 of the motor 21. When the motor 21 rotates either in one direction or in the opposite direction, the weight change structure 33 shifts and the motor 21 vibrates.

The weight change structure 33 is made up of a first dead weight 37, which has a given weight, equipped with the elastic stopper 35 and is supported at the rear shaft 23 of the motor 21. The elastic stopper 36 is fastened at the position of point symmetry on the side of the elastic stopper 35 of the plate 31.

The movable second dead weight 38, which has the same weight as the first dead weight 37, abuts with the elastic stopper 36 and is rotatably attached at the shaft center of the rear shaft 23 of the motor 21. When the motor 21 rotates in one direction, the movable first dead weight 38 moves to the side of the elastic stopper 36 by centrifugal force. The movable second dead weight 38 and the first dead weight 37 are stabilized at the positions of point symmetry to the shaft center, so that the weight at the side of the first dead weight 37 and at the side of the movable second dead weight 38 are balanced and allows normal continuous rotation.

Conversely, when the motor 21 rotates in the opposite direction, the movable second dead weight 38 moves to the side of the elastic stopper 35 by centrifugal force. The movable second dead weight 38 and the dead weight 37 are stabilized oppositely with the elastic stopper 35 as the border.

The weight of the shaft center is unbalanced towards one side. Therefore, the motor 21 generates a vibration from the imbalance of the weight of the movable dead weight 38 and the dead weight 37.

The turning structure 40 is made up of a worm 24 fastened to the front shaft 22 of the motor 21 and installed in the center of the flat box 41, which is made of a resin. Worm gears 42, 42 engage with opposite sides of the worm 24, so that they rotate in opposite directions simultaneously and are installed in the flat box. Bearings support the worm gears above and below the center shafts of the worm gears 42, 42 to allow them to rotate smoothly.

Figure 6:
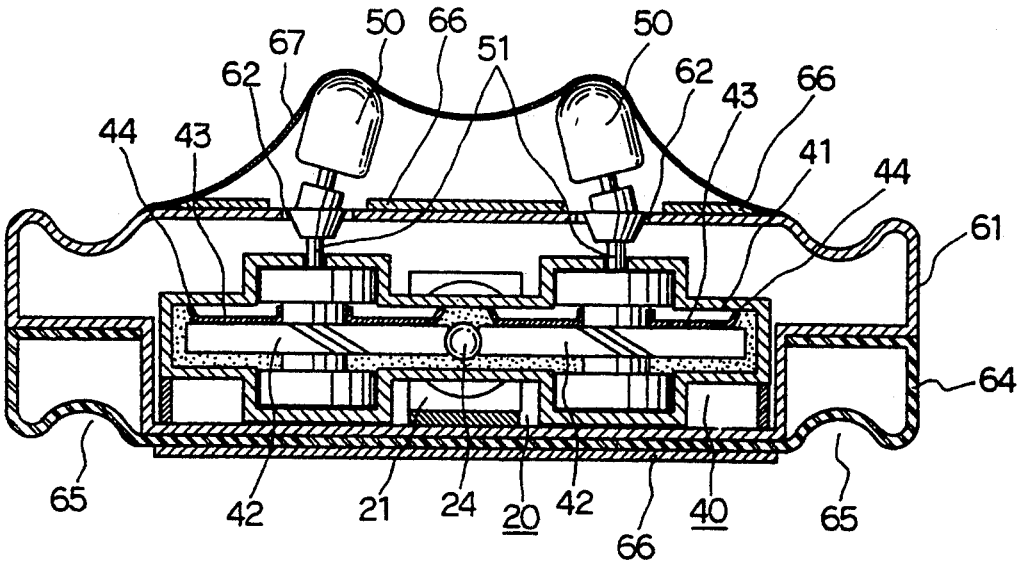
FIG. 6 is a central longitudinal sectional view of an embodiment of the present invention.

The turning structure 40 shown in FIG. 6 is an example. In this embodiment, ring vibration isolation boards 43, which are equipped with elastic walls 44, are disposed on at least one of the upper and lower surfaces of each worm gear 42, 42.

Lubricating oil is filled in between the circumference of the vibration isolation boards 43 and the flat box 41. By positioning the ring vibration isolation boards 43, the elastic walls 44 are pressed against the inner wall of the flat box 41 at a given pressure.

The lubricating oil prevents noise arising from the pressing of the elastic walls against the flat box, therefore, the ring vibration isolation boards absorb noise from the gears 42 and the vibration transmitted to the flat box 41 during the rotation of the worm gears 42, 42. That is, it removes noise and vibration.

Particularly, when the vibration is transmitted to the massaging balls 50 by the vibration generation means 30, the vibration isolation boards 43 remove the bad influence inside the turning structure 40 to the worm 24, the worm gears 42, 42 and so on.

The massaging ball 50 is, for example, formed like a cylinder with a ball part on its end and is made of an elastic member, such as a synthetic resin member, a rubber member and so on.

The massaging balls 50 are fastened on the support shafts 51, which are at an inclined angle and connected to the upper ends of the center shafts of the worm gears 42, 42. The massaging balls 50, 50 turn by the rotation of the worm gears 42, 42 respectively.

Numeral 60 in FIG. 5 shows a massage box equipped with drive equipment 20 comprising the vibration generation means 30 and the portable vibration finger pressure massager 10 which consists of the turning structure 40 and the massaging balls 50.

The massage box 60 consists of an upper case 61 and a lower case 64. The drive equipment 20, which comprises the vibration generation means 30, is fastened to the lower case 64.

Massaging balls 50, 50 project through round openings 62, 62 made in the upper case 61.

A plurality of projections 63, 63 for transmitting the vibration are made on both sides of corresponding positions around the openings 62, 62 above the motor 21 of the massage box 60. When vibration is generated by the vibration generation means 30, the vibration is concentrated on the projections 63, 63.

Handles 65 for carrying the portable vibration finger pressure massager 10 in one's hand may be provided at both sides of the massage box 60.

The surface of the massage box 60, except for the openings 62, 62 is covered with an elastic cover 66.

The entire surfaces of the cover 66 and the massaging balls 50, 50 are covered with the flexible cover 67.

Accordingly, when the user uses the portable vibration finger pressure massager of this invention, the massage box 60 is carried in the user's hand and the part of body to be treated, such as back, nape of the neck, arm, waist, thigh, calf, heel and so on, is pressed against the massaging balls 50, 50.

When, for example, the motor 21 rotates in one direction, the worm 24 rotates interlockingly with it. A pair of worm gears 42 engage with the worm 24 at opposite sides thereof and rotate in opposite directions.

The massaging balls 50, 50, which have the given angle and are fastened above the support shafts 51, 51, turn respectively.

The movable second dead weight 38 of the vibration generation means 30 moves to the side of elastic stopper 36 by the centrifugal force of the plate 31. The movable second dead weight 38 and the first dead weight 37 are stabilized at positions of point symmetry to the center of the plate 31. Consequently, the weight of the plate 31 at the side of the first dead weight 37 and the side of the movable second dead weight 38 are balanced to allow the provision of finger pressure rubbing massage without uncomfortable feeling from noise and vibration.

When the desired part of the body is pressed against the massaging balls 50, 50, conversely, the motor 21 rotates in the opposite direction and the worm 24 rotates in the opposite direction through its linkage with the motor 21.

A pair of worm gears 42 engage with opposite sides of the worm 24 and rotate in opposite directions so that the massaging balls 50, 50, which have the given angle and are fastened above the support shafts 51, 51, turn in the opposite directions respectively.

At the same time, the movable second dead weight 38 of the vibration generation means 30 moves to the side of the elastic stopper 35 by the centrifugal force of the plate 31. The movable second dead weight 38 and the first dead weight 37 are stabilized at one side of the plate 31 oppositely with the elastic stopper 35 as the border.

The weight of the plate 31 is unbalanced towards one side. Therefore, the motor 21 generates the vibration from the imbalance of the weight of the plate 31.

The inventive massager can give proper finger pressure rubbing massage and vibration massage by proper micro vibration on the body part without uncomfortable feeling from noise.

Further, when the many projections 62, 62 of the massage box 60 are pressed against the desired part of body and the motor 21 rotates in the opposite direction, the movable second dead weight 38 of the vibration generation means 30 moves to one side by the centrifugal force of the plate 31 like as mentioned above.

The vibration is generated from the imbalance in the weight of the plate 31 and the vibration is transmitted to the many projections 62, 62. Therefore, they can give proper micro vibration massage to the body part where the projections 62, 62 are pressed against.

That is, the portable finger pressure massager of this invention is equipped with the vibration generation means which comprises the weight change structure at the rear shaft of the motor in the drive equipment.

Only when the motor rotates in the opposite direction is the vibration generated. Therefore, there is no need for a small motor to be installed in the massaging ball like as in conventional massagers. By changing of the direction of the motor, at least two kinds of motions can be given.

When the body part is pressed against the massaging balls and the motor rotates in one direction, the massaging balls turn respectively and the finger pressure massage can be given to the part. When the motor rotates in the opposite direction, the massaging balls turn and vibrate.

In this invention, ring vibration isolation boards, which are equipped with elastic walls, are positioned against inner walls of the flat box at a given pressure and are placed on at least one of the upper and lower surfaces of each worm gear in the turning structure, and lubricating oil is filled in between the circumference of the vibration isolation boards and the flat box.

Accordingly, the vibration isolation boards completely absorb noise and vibration between the gears and between the gears and the flat box arising from the difference in size in the flat box and difference in engaging ratios between the worm and the worm gears and the lubricating oil absorbs the noise of sliding arising from the elastic walls pressing against the flat box.

As such, the present invention removes the uncomfortable feeling to the user and the bad influence to inside the turning structure, such as to the worm and the worm gears and so on, when the vibration generating member gives the vibration to the massaging balls.

Consequently, this invention solves the conventional defects and meets the various requests, and at least three kinds of massage, this is, finger pressure massage, vibration finger pressure massage and vibration massage, can be given optionally without an uncomfortable feeling to user.

If desired, vibration finger pressure massage and vibration massage can be given to adjoining body parts at the same time. Accordingly, this invention extends the range of use dramatically, is easy to carry, easy to use, and can be manufactured inexpensively.

The embodiments of the invention in which an exclusive property or privilege is claimed are defined as follows;

1. A portable vibration finger pressure massager comprising a drive worm disposed in a center portion of a box and a pair of worm gears engaged on opposite sides of the worm and rotatably disposed within the box, frames located above the worm gears and rotating disks disposed above said frames, massaging balls connected with the rotating disks at inclined angles relative to the axes of rotation of the rotating disks, a motor provided outside the box, said motor having a front shaft and a rear shaft, said front shaft extending into said box and driving said worm, a vibration generation means provided at the rear of said motor, said vibration generation means comprising a weight change structure attached to the motor rear shaft, said weight change structure comprising means for balancing said weight change structure when the motor rear shaft is rotated in a first direction and means for unbalancing said weight change structure when the motor rear shaft is rotated in a second direction opposite to said first direction so that a vibration is imparted to said massager.

2. The portable vibration finger pressure massager of claim 1 wherein ring vibration isolation boards are provided on at least one surface of an upper surface and lower surface of each worm gear the ring vibration isolation boards being provided with elastic walls which engage with an end wall of the box at a given pressure.

3. The portable vibration finger pressure massager of claim 1 wherein the box is provided with round openings from which the massaging balls extend and a flexible cover is provided for covering the massaging balls.

4. The portable vibration finger pressure massager of claim 1, wherein said weight change structure comprises a plate member having a first dead weight immovably attached thereto and a second dead weight constrained to move between a first position where said second dead weight is opposite to said first dead weight relative to said plate member and a second position where said second dead weight is adjacent to said first dead weight relative to said plate member, depending on the rotational direction of the motor rear shaft.

* * * * *

UNITED STATES PATENT AND TRADEMARK OFFICE

CERTIFICATE OF CORRECTION

PATENT NO. : 5 356 369

DATED : October 18, 1994

INVENTOR(S) : Yoshikiyo YAMASAKI, et al

It is certified that error appears in the above-indentified patent and that said Letters Patent is hereby corrected as shown below:

Column 10, line 38; after "gear" insert ---;---.

Signed and Sealed this

Seventh Day of March, 1995

*Attest:*

Bruce Lehman

BRUCE LEHMAN

*Attesting Officer*

*Commissioner of Patents and Trademarks*